US006505459B1

(12) United States Patent
Ruohio et al.

(10) Patent No.: US 6,505,459 B1
(45) Date of Patent: Jan. 14, 2003

(54) METHOD AND APPARATUS FOR WRAPPING OF PAPER AND BOARD ROLLS INTO A PACKAGE WRAPPING

(75) Inventors: Raimo Ruohio, Hämeenkoski (FI); Risto Forsström, Lahti (FI); Pertti Ojala, Lahti (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/600,440

(22) PCT Filed: Sep. 1, 1998

(86) PCT No.: PCT/FI98/00683

§ 371 (c)(1),
(2), (4) Date: Aug. 21, 2000

(87) PCT Pub. No.: WO99/36318

PCT Pub. Date: Jul. 22, 1999

(30) Foreign Application Priority Data

Jan. 16, 1998 (FI) ..... 980093

(51) Int. Cl.[7] ..... B65B 11/04; B65B 51/10
(52) U.S. Cl. ..... 53/465; 53/214; 53/372.9
(58) Field of Search ..... 53/399, 465, 449, 53/211, 214, 140, 587, 372.9

(56) References Cited

U.S. PATENT DOCUMENTS 2,575,467 A * 11/1951 Reichel ..... 53/449
2,716,315 A * 8/1955 Jacoby ..... 53/587
2,893,191 A * 7/1959 Lancaster ..... 53/140
5,265,399 A * 11/1993 Nishkanen ..... 53/465
5,768,858 A * 6/1998 Hannen ..... 53/565
5,974,768 A * 11/1999 Scholzke ..... 53/399

FOREIGN PATENT DOCUMENTS

SE 508 590 10/1998 ..... B65B/11/58

* cited by examiner

*Primary Examiner*—John Sipos
(74) *Attorney, Agent, or Firm*—Cohen, Pontani, Lieberman & Pavane

(57) ABSTRACT

A method and apparatus for wrapping paper and board rolls in a wrapper, in which method the roll (10) to be wrapped is conveyed to a wrapping station, is placed on support means and is rotated resting on said support means. The wrapper (24, 27) is threaded about the roll (10) to be wrapped so as to form at least two wrapper plies and the wrapper plies are bonded to each other at least partially with the help of a binder. The rolls to be wrapped are wrapped into at least two parallel and overlapped courses of wrapper using a wrapper web material whose surface is coated with a hot-melting and heat-sealable material that is melted prior to the wrapping of the wrapper about the roll in order to bind the superimposed plies of the wrapper to each other and to seal the joints of said overlapped courses of wrapper.

13 Claims, 4 Drawing Sheets

METHOD AND APPARATUS FOR WRAPPING OF PAPER AND BOARD ROLLS INTO A PACKAGE WRAPPING

PRIORITY CLAIM

This is a national stage of PCT application No. PCT/FI98/0063, on Sep. 1, 1998. Priority is claimed on that application, and on patent application No. 980093 filed in Finland on Jan. 16, 1998.

FIELD OF THE INVENTION

The present invention relates to a method and apparatus for wrapping paper and board rolls into a wrapper having a width smaller than the overall width of the roll.

BACKGROUND OF THE INVENTION

In the paper industry, paper rolls are conventionally packaged into a wrapper wound about the roll and then headers are placed on the ends of the roll. The purpose of the wrapper is to protect the roll from moisture, mechanical blows and to facilitate automated handling without the risk of damaging the roll itself. Frequently, two or more narrow rolls are typically wrapped in the same package, whereby the wrapper must be made sufficiently strong to keep the package intact. The wrapper material is of a thick paper or board, which may be coated with a plastic or, alternatively, comprised of a multilayer structure of different materials. The rims of the wrapper are conventionally allowed to extend over the roll edges and they are then crimped over inner headers placed to the roll ends and glued in place with the help of outer headers. Typically, the wrapper width is selected to be sufficiently wide so as to extend over the entire width of the roll being wrapped and provide an overlap for crimping over the roll edges. Hence, a paper mill must keep a plurality of different wrapper widths available, because the widths of produced rolls are obviously dictated by the roll width orders placed by customer. Obviously, a wrapping machine designed to operate at different wrapper widths is very complicated and expensive, because it must have support means for wrapper rolls of different widths and equipment for dispensing each wrapper type of different width to the roll being wrapped.

The roll to be wrapped may alternatively be wrapped by winding a number of wrapper plies thereon. Glueing is used to assure a positive locking of the wrapper plies on the roll and sufficient strength of the wrapper. The glueing of the wrapper may be implemented by spraying on the wrapper surface a hot-melt glue, which may be applied as a stripe or dots. It is also possible to use a wrapper with a thermoplastic polymer coating that is hot-melted prior to winding the wrapper on the roll surface. Conventionally, the wrapping operation is carried out by first adhering the wrapper to the roll surface and then glueing the last plies of the wrapper to each other. U.S. Pat. No. 5,265,399 describes a method and apparatus for making a roll package by means of a wrapper having its surface coated with a layer of a thermoplastic binder. In this method, the binder coat on the wrapper surface is melted in order to adhere the leading end of the wrapper to the roll and the trailing end to the last plies when the wrapping operation is completed. Further, at least some of the wrapper plies are adhered by heat-melting to each other during the wrapping operation. The wrapper width is equal to the full width of the roll and the hot-melted area is controlled by zones in order to obtain desired glueing patterns and cope with different wrapper widths. Also in this method, a plurality of different wrapper widths are used, whereby the wrapper machine must contain several wrapper rolls. The number of wrapper rolls may be 10 and more, whereby at least a portion of the wrapper rolls will have a long dispensing distance from the wrapper roll to the roll being wrapped. This may cause problems in threading the leading end of the wrapper. A wrapper machine of the above-described type must have separate backstands for rolls of different widths or, alternatively, separate storage sites from which the rolls are fetched to the wrapping machine. As a result, such a wrapping machine requires a very large footprint.

Canadian Patent Application No. 2,184,857 describes a wrapping machine in which a wrapper narrower than the width of the rolls being wrapped is wound about the roll obliquely to the center axis of the roll. The wrapper is adhered by a flowable glue or binder to both the surface of the roll being wrapped and the overlapped portion of the wrapper plies. The wrapper is not wound up to the roll ends, but instead, they are left partially free and, after the obliquely wound portion of the wrapper is completed, the wrapper roll is rotated so that the roll ends can be wrapped with circumferential wrapper portions overlapping the roll ends. These wrapper portions that extend over the roll ends are crimped against the roll ends in a conventional manner. While this method manages using a single-width wrapper roll only, the width of the wrapper must be very narrow due to the oblique wrapping technique in order to achieve reliable wrapping and to avoid leaving an excessively large unwrapped area. at the roll ends. The method provides a two-ply wrap package, but as a consequence of the obliquely wound structure of the wrap, the strength of the package cannot be increased essentially by using a greater number of wrap plies. Due to the narrow width of the wrapper, the wrapper equipment has a limited capacity and operates at a slow pace, because the roll must be rotated over a great number of revolutions, during which the wrapper roll position must be altered and it must be moved between the ends of the roll being wrapped. Such roll rotating and transfer equipment makes the wrapper machine complicated with respect to its wrapping capacity and its complex construction increases the cost of the machine. Moreover, this technique is incapable of wrapping a number of rolls in a single package, because the narrow circumferential wrapper at least in a two-ply wrap fails to support the package reliably at the abutting inner ends of the adjacent rolls.

International patent application No. PCT/FI97/00322 discloses an apparatus for wrapping rolls wider than the wrapper width with a narrow wrapper using a plurality of overlapping wrapper plies wound over the entire length of the roll. In this apparatus, the rolls to be wrapped are brought to the wrapping station and first located therein by aligning their first ends with the edge of the wrapper. Next, a required amount of wrapper is wound about said first end of the roll and then the second end of the roll is aligned with the other edge of the wrapper, after which a second number of wrapper plies is wound about the roll. In this method, the wrapper width must be equal to the width of the narrowest roll to be wrapped, because the wrapper may not extend over the roll ends. This requirement results from the fact that the above-described wrapper apparatus is intended for such a wrapping technique in which no headers are placed to the roll ends, whereby the overlapping rims of the wrapper cannot be crimped against the roll ends. The wrapper is fixed in place by glueing in a conventional manner. While no detailed description is given for the applied glueing technique, conventionally roll packages are secured using, e.g., a hot-melt glue which is dosed in dots or stripes. Such a glueing method does not necessarily give a sufficiently strong and moisture-proof package when the wrap is made from a number of adjacent wrapper plies.

SUMMARY OF THE INVENTION

It is an object of the present invention to provide a method and apparatus suited for packaging paper and board rolls in a wrapper narrower than the roll width and simultaneously rendering a strong and highly durable package with a good moisture resistance.

The goal of the invention is achieved by wrapping the rolls to be packaged in a wrapping consisting of at least two plies of adjacent turns of a packaging wrapper having its surface coated with a hot-melting and cool-adhering binder material which is melted prior to the wrapping of the wrapper about the roll so that at least the first ply of the wrapper at the portion extending over the roll end is not heated and at least the superimposed portions of wrapper plies at the crimped wrapper edges and the overlapping portions of the adjacent wrapper plies are hot-melt bonded to each other.

Frequently, also the first ply of the wrapper facing the roll surface is hot-melt bonded to attach the wrapper to the roll and the last ply of the wrapper is entirely hot-melt bonded to achieve a tight and durable bond of the wrapper trailing end.

The invention offers significant benefits.

Today, packages of paper and board products are required to exhibit an extremely high performance. In addition to the need for protecting a roll efficiently during handling and transportation, the package must have a good appearance. In overlap wrapping, it is more difficult to attain a high quality as the wrapper wound about the roll comprises a plurality of adjacent plies. However, roll packages made by overlap wrapping are expected to be as good as those made from a full-width wrapper. The invention makes it possible to attain the same strength and moisture-proofness as those offered by a full-width wrapper, since now the wrapper plies can be hot-melt bonded to each other if so required. Prior-art techniques of attaching the wrapper have not been able to assure sufficient strength of the wrapper bond in the same fashion as the present invention. Through using a narrow wrapper web, also the width of the heating equipment can be made narrower, thus making the present wrapping system more cost-attractive than an apparatus based on wrapping with a wide wrapper. This is a significant benefit particularly in conjunction with the use of infrared heaters, because wide infrared heater systems are handicapped by a relatively high energy consumption. Furthermore, the wrapper need not necessarily contain a separate moisture-barrier layer, because the heat-sealable polymer coating can act as a sufficient moisture barrier if so required.

The width of the wrapper rolls can be selected optimally according to the packaging needs. Frequently, it is advantageous to have one wrapper width suited for the narrowest roll lo be wrapped and a second wrapper width for wrapping the most common widths of rolls inasmuch the proportion of rolls of a given width is very high in the overall production volume of a paper mill. By means of an optimal selection of wrapper widths, most of the rolls can be packaged with a single course of wrapper plies, whereby the capacity of the apparatus becomes high and no compromising in the flexibility of the packaging system is necessary. Moreover, the apparatus according to invention offers all the benefits attainable by virtue of overlap wrapping such as a smaller footprint of the apparatus and a reduced selection and inventory of wrapper materials. Owing to the ease of using a greater number of wrapper plies, wrappers of lower base weight can be used. Furthermore, the operating and investment costs of the apparatus are more profitable than those of conventional equipment. Significant savings can be attained in the use of the wrapper material as the top end of the roll can be wrapped with a wrapper of lower base weight than the bottom end of the roll which needs a wrapper of higher mechanical strength.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
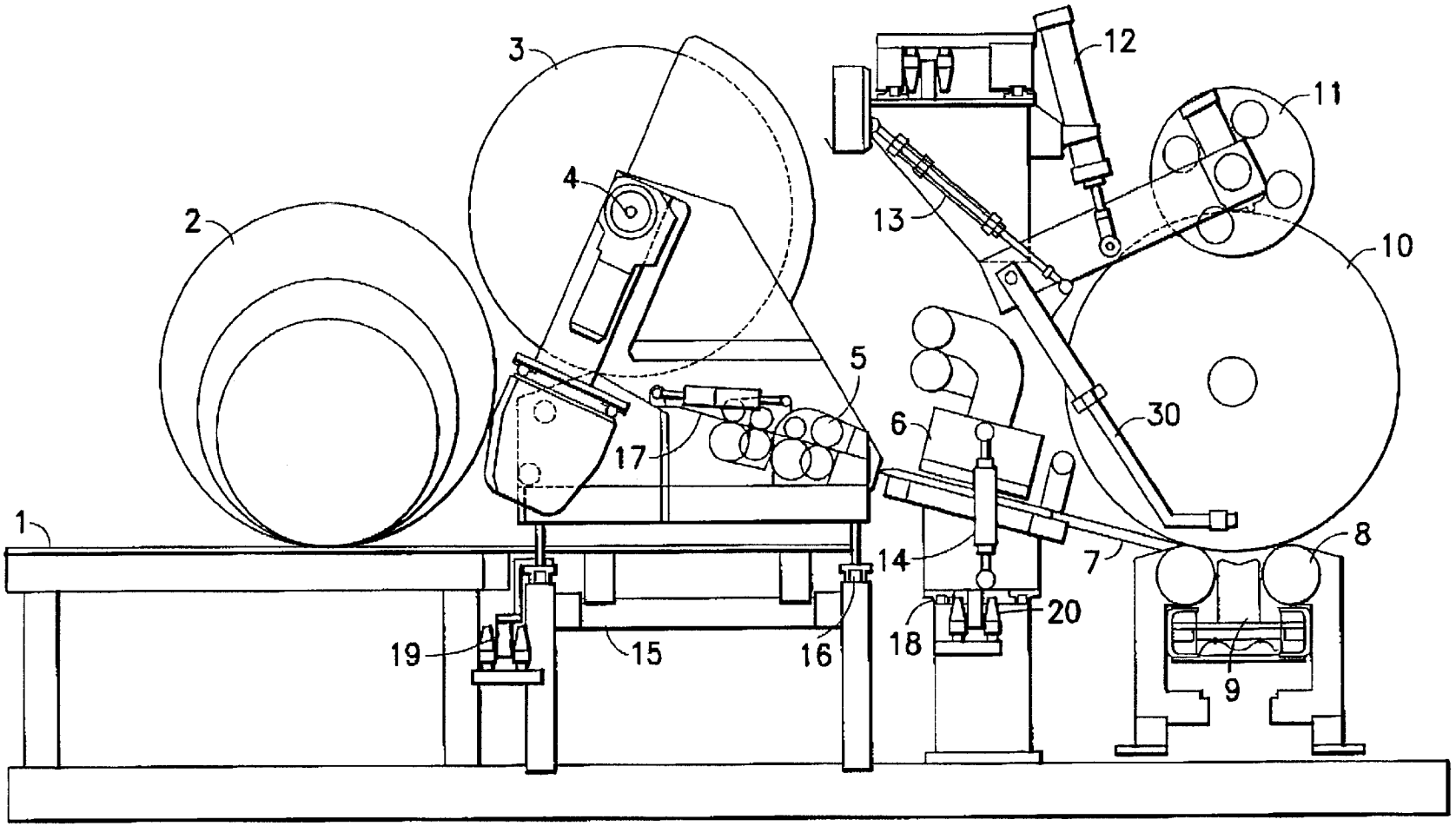
FIG. 1 shows the side view of an apparatus according to the invention.
Figure 2:
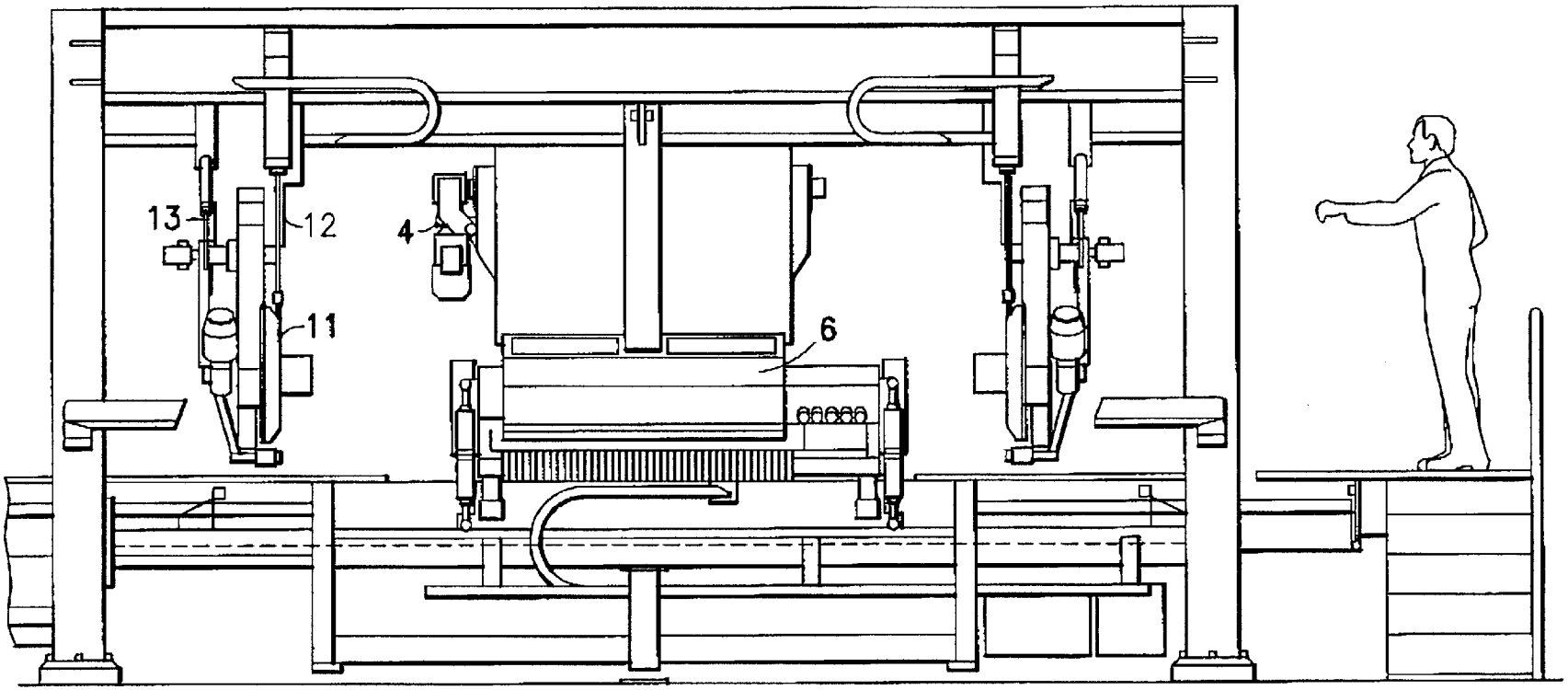
FIG. 2 shows a front view of the apparatus of FIG. 1.

Referring to FIGS. 1 and 2, the apparatus shown therein is designed for use in installations in which the roll 10 to be packaged comes to the wrapping station longitudinally aligned. In this configuration, the roll 10 is moved with a conveyor 9, and at the wrapping station the roll is placed on support rollers 8 by way of altering the mutual elevation of the conveyor 9 and the support rollers 8. At the wrapping station, on the opposite side to the support rollers 8, there is provided a storage table 1 serving to store wrapper rolls 2 of different widths. The wrapping station itself is constructed on a frame 15, and the wrapper dispensing equipment and the wrapper roll 3 being dispensed at the wrapping station are mounted on rails 16 running parallel to the roll 10 being wrapped. The position of the wrapper-dispensing equipment is monitored by means of a linear position transducer 19 which is mounted beside the frame 15 and is rigidly connected to said wrapper-dispensing equipment. The wrapper-dispensing equipment comprises rotatable arms 4 for supporting the wrapper roll 3, complemented below the wrapper roll 3 with a first section 17 of a wrapper dispensing table equipped with conventional pulling rollers for feeding the wrapper and a cutting device 5 for severing the wrapper. The first section 17 of the wrapper dispensing table is made slightly downward inclined and its lower end joins with a second section 7 of the wrapper dispensing table that is continued up to the support roller 8 of the wrapping station.

Above the second section 7 of the wrapper dispensing table is adapted an infrared heater 6, later called an infrared heater beam, with a width equal to that of the wrapper being used. The second section 7 of the wrapper dispensing table and the infrared heater 6 are adapted to move synchronously with the wrapper dispensing equipment on the rails 18, and the position of the second section 7 of the wrapper dispensing table is monitored by means of a linear position transducer 20. The infrared heater 6 is mounted on actuator cylinders 14, and the heater position from the second section 7 of the wrapper dispensing table can be altered by means of these actuator cylinders. Further included in the apparatus is a wrapper edge crimper device 11, which is moved by an actuator cylinder 12, and a holder arm 30 serving to keep a header against the end of the roll 10 being wrapped during the initial phase of the wrapper edge crimping step. The holder arm 30 is actuated by an actuator cylinder 13. It must be noted herein that, for the sake of greater clarity, some details of the wrapping station frame construction are omitted herein.

Figure 3:
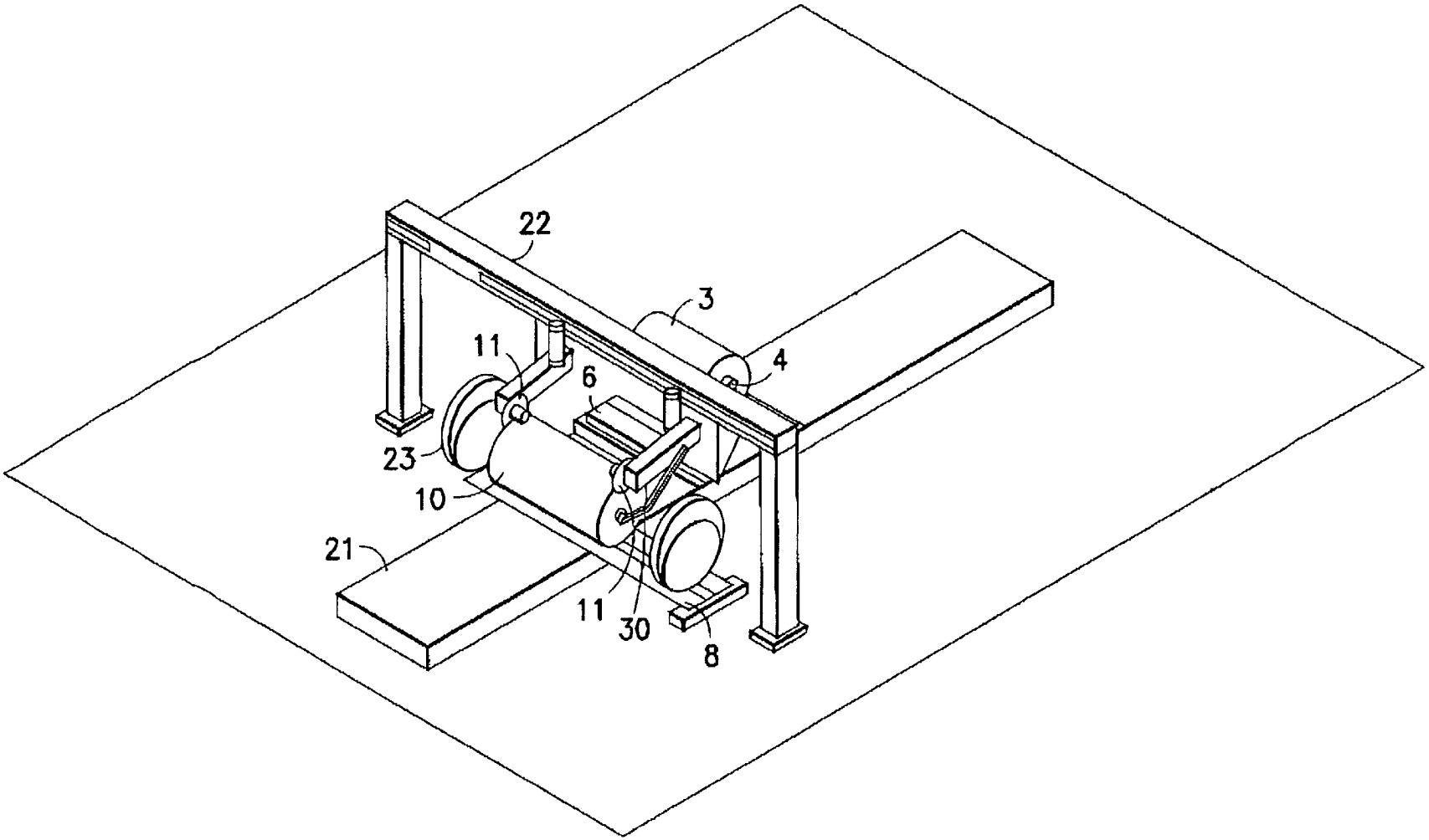
FIG. 3 shows a perspective view of the apparatus of FIG. 1 in a different operating environment.

In FIG. 3 is shown the wrapping apparatus of FIG. 1 in an operating environment in which the roll 10 being wrapped is brought to the wrapping station by rolling down along a ramp 21, and the ready-packaged roll is removed from the wrapping station again by rolling down along the same ramp. In the illustrated embodiment, the crimping devices 11 and the header holder arms 30 are mounted on a beam 22 running above the wrapping station thus permitting their movement along said beam. On the opposite side to the transfer ramp 21 of the rolls 10 to be packaged, there is located a long storage table along which new wrapper rolls can be introduced to the wrapping station. Outer header insertion devices 23 are shown schematically in their operating positions at both ends of the roll resting on the support rollers 8. As can be seen from the diagram, the wrapper roll 3 and the infrared heater 6 have a width essentially narrower than the width of the roll 10 being wrapped. Thence, a number of adjacent wrapper plies must be wound on each roll being wrapped. Typically, provided that the difference between the narrowest roll and widest roll delivered from the paper mill is sufficiently small, even the widest roll to be wrapped can be packaged using only two adjacent courses of wrapper.

Figure 4A:
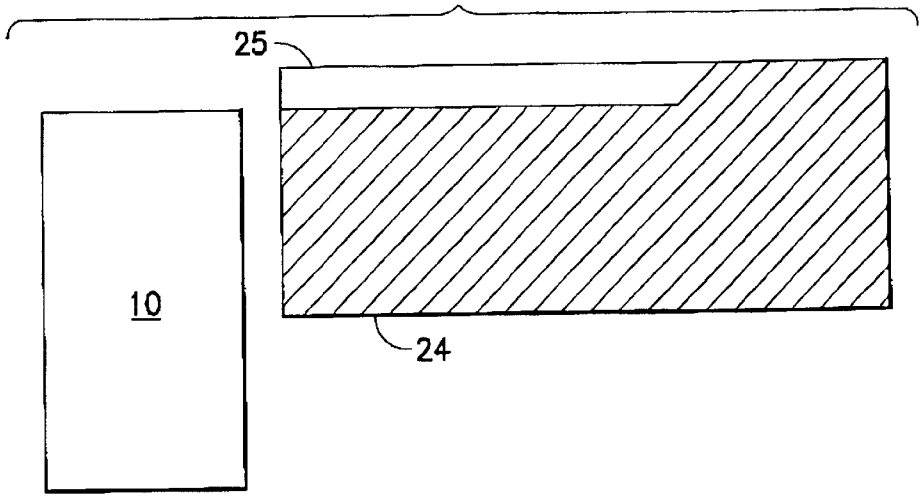
FIGS. 4*a* and 4*b* show schematically the steps of winding and glueing a wrapper about a roll to be packaged.
Figure 4B:
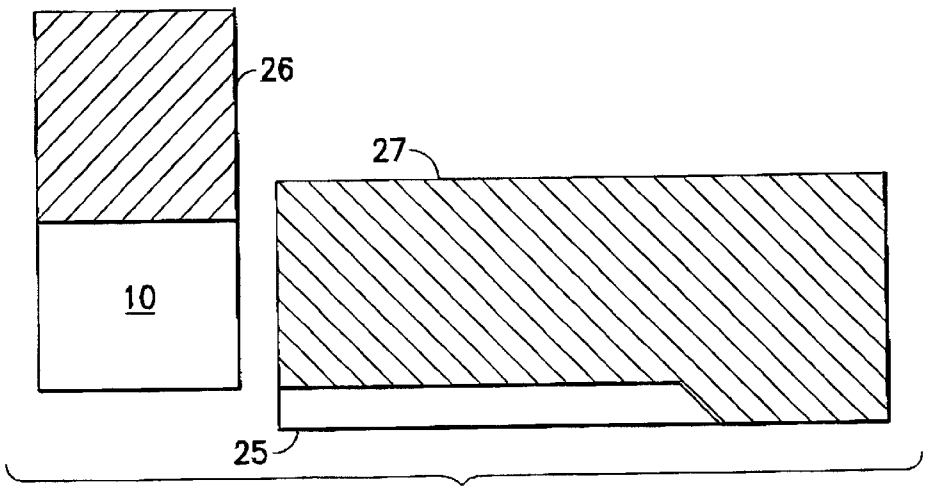

The wrapping of rolls by virtue of the wrapping apparatus described above takes place as follows:

The roll 10 to be packaged is brought to the wrapping station, and the wrapper roll 3 and the crimping devices 11 are positioned in regard to the roll 10 so that the edge of the wrapper 24 in the longitudinal direction of the roll 10 will extend sufficiently far over the end of the roll in order to crimp the wrapper at the roll end. The heater assembly of the infrared heater beam 6 is segmented into units that can be controlled individually. As the first ply of the wrapper shall not be allowed to the end of the roll 10, the heater beam is controlled so as not to heat the wrapper edge during the wrapping of the first wrapper ply. Then, an unbonded area 25 will be left at the edge of the wrapper 24 as shown schematically in FIGS. 4*a* and 4*b* in which the wrapper 24 being wound about the roll 10 to be wrapped is shown developed. After the first ply of the wrapper is wound, the heater is controlled to extend its heat to the entire width of the wrapper, whereby also the edge of the wrapper 24 is bonded to the underlying wrapper plies thus providing in cooperation with the roll headers a headered roll package of high mechanical strength and good moisture-barrier properties. The control of the infrared heaters can be implemented using, e.g., thyristor controllers or other suitable control techniques. The first wrapper ply is first entirely wound about the roll, whereby also the edge of this wrapper ply is folded against the end of the roll 10 by means of the crimping device 11. Simultaneously, the crimping device at the other end of the roll 10 is kept pushing against the roll end in order to keep the roll in place during the crimping step. For this task, the crimping devices may be provided with a support roller.

After the first wrapper course 26 is wound over the first end of the roll 10, the wrapper roll 3 is moved in regard to the longitudinal axis of the roll 10 being wrapped. If the entire length of the roll can be wrapped using only two adjacent wrapper courses, the wrapper roll 3 is repositioned so that the wrapper edge at its other end can be crimped in the same manner as described above. During the wrapping of the second wrapper course 27, the infrared heater beam 6 is controlled in the same manner as above, whereby an unbonded area 25 is formed at the edge of the first ply of the wrapper. On the other hand, it must be secured that the second wrapper course 27 will sufficiently overlap the first wrapper course and firmly adhere thereto s;o as to form a tight package. When a greater number of adjacent wrapper courses must be wound about the roll 10 being wrapped, the wrapping order is advantageously selected so that the wrapper course to be located lowermost after the ready-wrapped roll erected in an upright position is wound first and next wrapper courses are wound sequentially overlapping one another along the longitudinal axis of the roll so that the each of the staggered wrapper courses in the sequence starting from the first wrapper course toward the opposite end of the roll will overlap its preceding wrapper course in scale-like manner. Thus a wrap package will be obtained in which the overlap joints between the stepped wrapper courses of erected roll are tiled downward thus preventing accumulation of water in the joint. As this type of a wrapping method provides a very durable package, the mechanical strength of the package can be secured by wrapping the first wrapper course to a sufficient thickness on the roll and then using thinner wrap for the subsequent wrapper courses, whereby the latter may serve only to give desired moisture-barrier properties to the package.

In addition to those described above, the invention may have alternative embodiments.

For instance, the roll may also be positioned in regard to the wrapper dispensing equipment by transferring the roll in the direction of its longitudinal axis, but this arrangement is clumsier than that in which the wrapper roll its dispensing equipment is moved. The invention may be adapted to all conventional wrapping station layouts. Instead of using infrared heaters, the heating of the binder or glue can be accomplished with the help of other types of heaters such as flame lances, a laser, microwave radiators or the like, whereby the benefit of infrared heaters is therein that the heat can be effectively imposed on the binder inasmuch as the most common kinds of glues and polymer binders are efficient absorbers of infrared radiation. In some cases it is possible to use lighter type of glueing, whereby the glue can be applied using a desired pattern of dots, stripes or different kinds of segments. However, arrangements must be made herein to melt the glue at least in the superimposed plies of the crimped portion and the overlapping areas of the adjacent wrapper plies in order to secure the tightness of the package. The wrapper web can be chosen from a wide selection of wrapper materials coated with a thermoplastic binder layer and examples of such materials are mentioned in the U.S. Pat. No. 5,265,399.

In overlap wrapping, the overlapping areas of the adjacent wrapper plies will form a bump that in rolls of more delicate paper grades may cause marking on the outer plies of the roll being wrapped. Then, it may be necessary to protect the overlap area in order to prevent marking. The simplest technique herein is to wrap the roll at the overlap region with a thin layer, for instance, using only one ply of the same wrapper which is employed for packaging the roll. This wrapper ply prevents the edge of the actual wrapper ply from possibly marking the outer surface of the roll, while simultaneously the edges of the marking-prevention wrapper ply are so thin as not to cause a risk of print-through marking by the protective layer itself. Alternatively, the marking-protection wrapper may be of a purpose-made web grade, whereby it should be very thin and stiff in order to render the desired protective effect. In the case that the web which is used as the wrapper proper is not also used as the marking-prevention web, the width of the latter wrapper web may be selected in a desired manner with the obvious provision that it is sufficiently wide for extending over a desired width at the overlap joint, whereby its width must be at least equal to that of the overlap joint, but not wider than the roll being wrapped. Such an additional wrapper course may also be employed to fortify the package, e.g., at the areas grabbed by the transport equipment, whereby the extra wrapper can be wrapped over the actual wrapper plies, too.

The wrapping method according to the invention makes it easy to optimize the strength of the package by varying the position and mutual placement of the wrapper courses thus achieving a package of maximized performance for the needs of both the manufacturer and the customer.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method of wrapping a paper or board roll in a wrapper comprising the steps of:

conveying a roll to be wrapped having a longitudinal axis to a wrapping station and placing the roll on a support means;

rotating the roll to be wrapped on the support means;

wrapping a plurality of wrapper sheets about the roll to be wrapped and perpendicular to said axis of the roll to be wrapped so as to form superimposed plies of at least two parallel and at least partially overlapped courses of wrapper, the wrapper sheets for each course of the wrapper being dispensed as a web from the same wrapper roll which is moved in a direction parallel to the axis of the roll to be wrapped, a portion of a surface of each wrapper sheet being coated with a hot-melting and heat-sealable material; and heating the hot-melting and heat-sealable material prior to wrapping of the wrapper sheets about the roll to bind the superimposed plies of the wrapper to each other and to seal joints of the overlapped courses of wrapper, wherein the hot-melting material on the surface of the wrapper is heated so that at least a first ply of the wrapper at a portion extending over an end of the roll to be wrapped is not heated and so that at least superimposed portions of wrapper plies at wrapper edges and the overlapping portions of the adjacent wrapper plies are hot-melt bonded to each other.

2. The method of claim 1, wherein the first ply of the wrapper facing the surface of the roll to be wrapped is hot-melt bonded to attach the wrapper to the roll and the last ply of the wrapper is hot-melt bonded to achieve a tight and durable bond to a trailing end of the wrapper.

3. The method of claim 1, wherein the portion of the wrapper extending over the ends of the roll to be wrapped are crimped against ends of the roll by means of a crimping device, the roll to be wrapped being supported during wrapping by the crimping device.

4. The method of claim 1, wherein the courses of the wrapper plies are wound sequentially staggered so that the wrapper courses partially overlapping a preceding wrapper course will be above a preceding wrapper course when the wrapped roll is stood on an end of the wrapped roll.

5. The method of claim 4, wherein one end of the wrapped roll is protected with a smaller amount of wrapper that another end of the wrapped roll.

6. The method of claim 1, wherein the hot-melting and heat-sealable material is heated by a segmentally controllable infrared heater.

7. The method of claim 1, wherein a width of the wrapper roll is selected so that it can be used for wrapping a majority of roll widths in the production of a paper mill using a single course of wrapper, whereby wider rolls are wrapped using two or more courses of wrapper.

8. The method of claim 1, further comprising wrapping at least one additional course of wrapper on the roll to be wrapped.

9. The method of claim 8, wherein additional courses of wrapper are wound about the roll to be wrapped at overlap joints of the wrapper.

10. The method of claim 9, wherein the wrapper for the additional courses of wrapper is taken from a web of the same wrapper roll used to wrap the roll to be wrapped.

11. The method of claim 9, wherein the wrapper for the additional courses of wrapper is taken from a web of a wrapper roll different from that used to wrap the roll to be wrapped.

12. An apparatus for wrapping a paper or board roll in a wrapper comprising:

a means for conveying a roll having a longitudinal axis to be wrapped to a wrapping station;

a means for supporting the roll to be wrapped during wrapping;

a means for placing the roll to be wrapped on the support means;

a means for rotating the roll to be wrapped on the support means;

a means for wrapping at least two parallel and at least partially overlapped courses of a wrapper about the roll to be wrapped perpendicular to said axis of the roll to be wrapped to form superimposed plies, the wrapping means comprising a wrapper roll, the wrapper for each course of the wrapper being dispensed as a web from the same wrapper roll, a portion of a surface of the wrapper being coated with a hot-melting and heat-sealable material;

a means for moving the wrapper roll in a direction parallel to the axis of the roll to be wrapped, so as to permit dispensing of the wrapper onto the roll to be wrapped to wrap the roll in at least two parallel and at least partially overlapping courses of wrapper; and a means for heating the hot-melting and heat-sealable material prior to wrapping of the wrapper about the roll to bind superimposed plies of the wrapper to each other and to seal joints of overlapped courses of wrapper so that the hot-melting material on the surface of the wrapper is heated so that at least a first ply of the wrapper at a portion extending over an end of the roll to be wrapped is not heated and so that at least superimposed portions of wrapper plies at wrapper edges and the overlapping portions of the adjacent wrapper plies are hot-melt bonded to each other.

13. The apparatus of claim 12, wherein the heating means comprises a segmentally controllable infrared heater.

* * * * *